US005146745A

United States Patent [19]

Doetsch

[11] Patent Number: 5,146,745

[45] Date of Patent: Sep. 15, 1992

[54] STEERING SIGNAL CONVERSION MANIFOLD

[75] Inventor: Peter Doetsch, North Vancouver, Canada

[73] Assignee: Jastram Engineering, Ltd., N. Vancouver, Canada

[21] Appl. No.: 583,483

[22] Filed: Sep. 17, 1990

[51] Int. Cl.[5] ..... F16D 31/02

[52] U.S. Cl. ..... 60/403; 60/327; 60/386; 114/144 R

[58] Field of Search ..... 60/403, 327, 385, 386, 60/571; 91/360, 363 A; 114/144 R; 440/60; 180/132, 133

[56] References Cited

U.S. PATENT DOCUMENTS

| | | | |
|---|---|---|---|
| 2,892,310 | 6/1959 | Mercier | 60/385 |
| 3,016,708 | 1/1962 | Gordon et al. | 60/386 X |
| 3,390,614 | 7/1968 | Tatum | 114/144 R X |
| 3,536,979 | 10/1970 | Reutecer et al. | 91/360 |
| 4,003,202 | 1/1977 | Becker | 60/385 |
| 4,004,537 | 1/1977 | Nilsson | 114/144 E X |
| 4,519,335 | 5/1985 | Krautkremer et al. | 114/144 R |
| 4,736,811 | 4/1988 | Marsden et al. | 180/133 |
| 4,933,617 | 6/1990 | Huber et al. | 114/144 R X |
| 4,955,445 | 9/1990 | Kauss | 180/133 |

FOREIGN PATENT DOCUMENTS

| | | | |
|---|---|---|---|
| 0420059 | 7/1923 | Fed. Rep. of Germany | 60/571 |
| 0022049 | 10/1956 | Fed. Rep. of Germany | 114/144 R |
| 1135025 | 4/1957 | France | 60/571 |
| 0223074 | 9/1989 | Japan | 180/132 |
| 0994341 | 2/1983 | U.S.S.R. | 60/386 |

*Primary Examiner*—Edward K. Look
*Assistant Examiner*—Todd Mattingly

[57] ABSTRACT

A manifold is disclosed for converting a manual hydraulic steering signal into a proportional electrical signal. The manifold is connectable between a hydraulic fluid supply, such a helm pump, and a hydraulic steering cylinder and includes a rotary actuator responsive to variations in the flow of hydraulic fluid from the fluid supply. The manifold is useful for converting small marine vessels from manual to power steering and for providing emergency manual steering in large tankers and the like.

20 Claims, 4 Drawing Sheets

STEERING SIGNAL CONVERSION MANIFOLD

FIELD OF THE INVENTION

This application relates to an apparatus for converting a manual hydraulic steering signal to a proportional electrical signal. More particularly, this application pertains to a manifold which may be retrofitted into small marine vessels to convert such vessels from manual to power steering. The manifold may also be installed in large tankers and the like to provide manual emergency steering.

BACKGROUND OF THE INVENTION

Many small marine vessels, such as fishing boats, have manual hydraulic rather than power steering. Such vessels are controlled by rotating a steering wheel which causes delivery of hydraulic fluid from a helm pump directly to one or more steering cylinders which control the position of the vessel's rudder. The disadvantages of manual steering are well recognized. For example, the steering wheel must typically be rotated a large number of revolutions in order to change the direction of the vessel. Generally speaking, the larger the vessel, the more effort is required to steer manually.

Other steering problems may arise in large marine vessels such as tankers (which typically include power steering systems). The primary problem is that it is not possible to effectively steer such vessels from the wheelhouse if the power system fails. Rather, the pilot must instruct remote operators in the steering gear flat or compartment to manually alter the position of the steering cylinders. If this back-up voice communication system fails, or if the pilot's instructions are misunderstood or misinterpreted, safe control of the vessel may be lost.

It is known in the prior art to provide manual emergency steering in the event of power steering failure, but such systems are often unreliable or expensive to install. U.S. Pat. No. 3,468,126, which Was granted to Mercier on Sept. 23, 1969, discloses a hydraulic position control system for controlling the direction of a ship which includes manual or electrical control means. In the event of a power failure, a manually operated hydraulic fluid pump is connected directly to the steering cylinders to permit manual operation of the vessel. The primary disadvantage of the Mercier system is that it is relatively complicated and expensive to manufacture and it cannot be easily retrofitted into existing vessels, such as small-sized fishing boats. Further, the Mercier system does not specifically disclose any means for converting a manual hydraulic steering signal into a proportional electrical signal.

The need has arisen for a steering signal conversion apparatus which can be conveniently retrofitted into existing vessels to provide power steering, and which may also be readily installed in larger vessels to provide back-up, emergency manual steering. The present invention satisfies both these needs in a simple and economical manner.

SUMMARY OF THE INVENTION

In accordance with the invention a conversion manifold is provided which is connectable between a hydraulic fluid supply and a hydraulic cylinder. The manifold has at least one inlet port for receiving hydraulic fluid from the hydraulic fluid supply and at least one outlet port for enabling delivery of hydraulic fluid from the manifold to the hydraulic cylinder. The manifold has a first conduit for connecting the inlet and outlet ports and an internal chamber within the manifold in communication with the first conduit. Diverter means are provided for selectively diverting hydraulic fluid from the first conduit into the internal chamber. The internal chamber houses an actuator responsive to variation in the flow of hydraulic fluid into the chamber. An electrical signal generator cooperates with the actuator to generate a signal proportional to the change in position of the actuator.

A second conduit is preferably provided for connecting the first conduit and the internal chamber. Advantageously, the diverter means is located at the juncture of the first conduit and the second conduit and is adjustable between a first position enabling flow of hydraulic fluid from the first conduit into the second conduit, and a second position preventing flow of hydraulic fluid from the first conduit into the second conduit. The diverter means may be a solenoid cartridge valve connectable to a power source. The valve is deployed in the first position when the solenoid is energized and is deployed in the second position when the solenoid is deenergized.

The internal chamber in preferably cylindrical in shape. The actuator is preferably a rotor having a vane rotatable about a shaft extending through the centre of the chamber to divide the chamber into two substantially fluid-tight portions. Preferably the signal generating means is a potentiometer coupled to one end of the rotor shaft, although a hall effect switch (magnetic field sensor) or an optical decoder may also be employed to like effect.

The conversion manifold may be a unitary block having a pair of inlet ports, a corresponding pair of outlet ports, and a corresponding pair of conduits connecting the respective inlet and outlet ports. Hydraulic fluid received from a fluid supply, such as a helm pump, is selectively diverted into one or the other of the aforesaid chamber portions to cause displacement of the rotary actuator and hence generation of a corresponding electrical signal.

The conversion manifold is designed to interface with conventional hydraulic steering systems comprising a helm pump, a steering cylinder and a potentiometer, amplifier and pumpset for regulating flow of hydraulic fluid to the steering cylinder.

BRIEF DESCRIPTION OF THE DRAWINGS

In drawings which illustrate specific embodiments of the invention, but which should not be construed as restricting the spirit or scope of the invention in any way.

DETAILED DESCRIPTION OF THE PREFERRED EMBODIMENT

Figure 1:
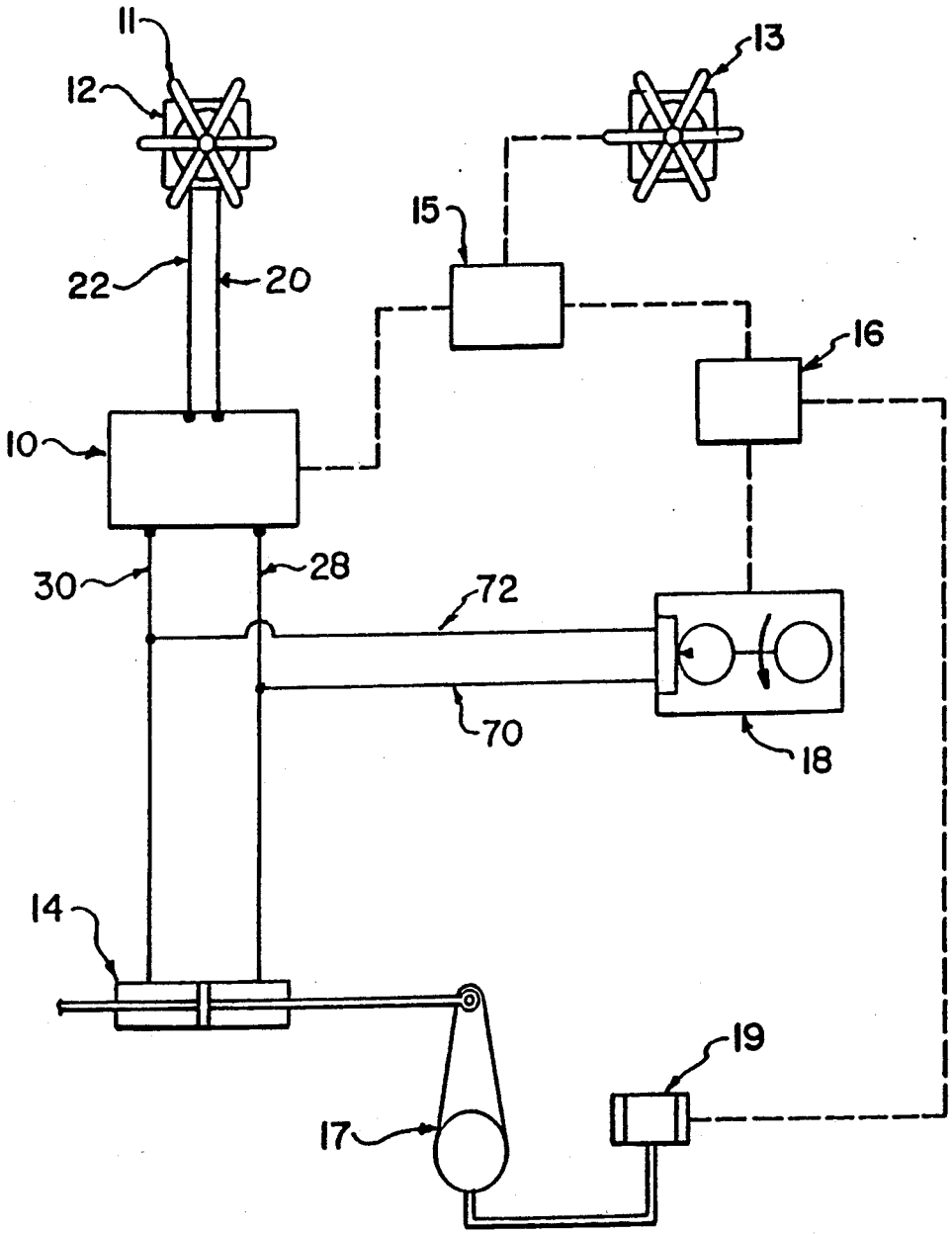
FIG. 1 is a schematic drawing showing the interconnection between the conversion manifold of the present invention and the other components of a typical hydraulic steering system.

Many small marine vessels, such as commercial fishing boats, have manual hydraulic rather than power steering. As shown schematically in FIG. 1, such vessels typically have a helm pump 12 which delivers hydraulic fluid to one or more hydraulic steering cylinders 14 when manual steering wheel 11 is rotated. Steering cylinder 14 controls the position of rudder 17. For example, when steering wheel 11 is rotated in a clockwise direction, hydraulic fluid is pumped from helm pump 12 through a fluid supply line directly to steering cylinder 14 which causes the vessel to turn in a starboard direction. Conversely, if steering wheel 11 is rotated counterclockwise, hydraulic fluid is pumped from helm pump 12 through a different fluid supply line to steering cylinder 14 to cause the vessel to turn in a port direction.

In addition to, or in substitution for, the purely hydraulic steering system described above, many vessels have an autopilot. As shown in FIG. 1, most commercial autopilots have an amplifier 16 which may be interfaced to an electric steering wheel 13 by means of a potentiometer 15 connected to the inner shaft of steering wheel 13. When steering wheel 13 is rotated, potentiometer 15 generates an electrical signal which is transmitted to amplifier 16. Amplifier 16 sends a corresponding output current to one or more control valves on a pumpset 18 which causes delivery of hydraulic fluid from pumpset 18 to steering cylinder 14 to result in the desired rudder motion. A follow-up 19 may also be provided for transmitting a feed-back signal indicative of the position of rudder 17 to the amplifier unit 16.

Figure 2:
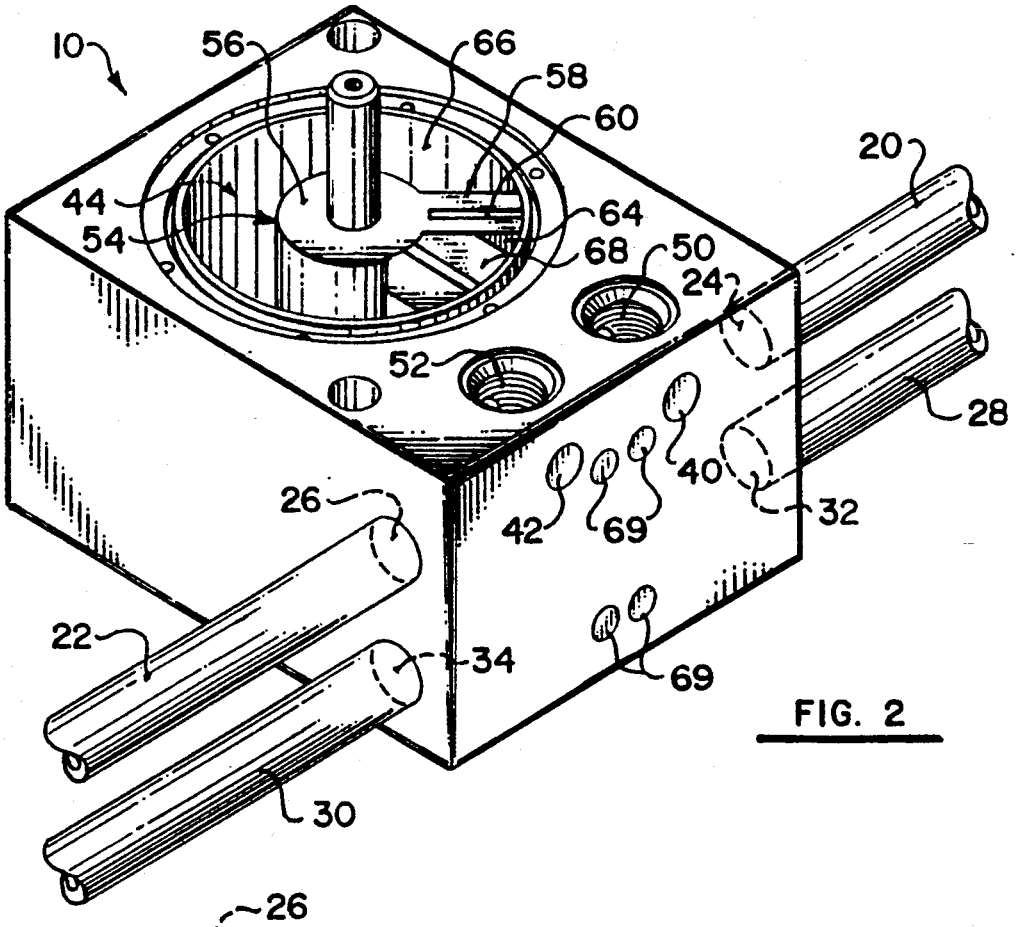
FIG. 2 is a perspective view of the conversion manifold of the present invention with the top cover plate removed to show the rotary actuator housed within the internal chamber.

The present invention is primarily directed to a conversion manifold 10 for converting a manual hydraulic steering signal into a proportional electrical signal. As shown in FIGS. 1 and 2, manifold 10 is connected to fluid supply lines extending between helm pump 12 and steering cylinder 14. Manifold 10 is designed to interface with the amplifier 16 of a standard, pre-installed autopilot capable of receiving foreign commands. Alternatively, if the vessel in question does not have an autopilot, amplifier 16 and pumpset 18 may be retrofitted into the vessel together with conversion manifold 10 and potentiometer 15.

The installation of manifold 10 essentially converts steering wheel 11 from manual to electric steering. By way of overview, when power is supplied to control valves 46,48 positioned within manifold 10, hydraulic fluid from helm pump 12 is diverted into an internal hydraulic fluid chamber 44. Chamber 44 is fitted with a rotary actuator 54 described in further detail below. Rotary actuator 54 rotates as steering wheel 11 is rotated which in turn causes rotation of potentiometer 15 coupled to the outermost end of the rotor shaft. Potentiometer 15 generates an electrical signal which is transmitted to amplifier 16. Amplifier 16 sends a corresponding output current to one or more directional control valves on pumpset 18 as described above. The control valve(s) directs the flow of hydraulic fluid from pumpset 18 directly to steering cylinder 14 to cause the desired rudder motion.

In the event of a power interruption, control valves 46,48 are deenergized and helm pump 12 is automatically connected to steering cylinder 14 to provide emergency manual steering, as discussed further below.

Referring to FIG. 2, conversion manifold 10 is preferably a unitary block constructed from aluminum, cast iron, stainless steel or any other suitable oil-impervious material. Manifold 10 is connected to a hydraulic fluid supply, such as helm pump 12, by fluid supply lines 20 and 22. Starboard fluid supply line 20 is connected to manifold inlet port 24 and port fluid supply line 22 is connected to manifold inlet port 26. Preferably inlet ports 24,26 are located on opposite sides of manifold 10. When steering wheel 11 is rotated clockwise, hydraulic fluid is pumped from helm pump 12 through starboard fluid supply line 20 to manifold inlet 24. Conversely, when steering wheel 11 is rotated counterclockwise, hydraulic fluid is pumped from helm pump 12 through port fluid supply line 22 to manifold inlet 26.

Manifold 10 is also connected directly to steering cylinder 14 by fluid supply lines 28 and 30. Starboard supply line 28 is connected to outlet port 32 and port supply line 30 is connected to outlet port 34. Outlet ports 32,34 are preferably located on opposite sides of manifold 10 proximate to inlet ports 24, 26 respectively.

Figure 5:
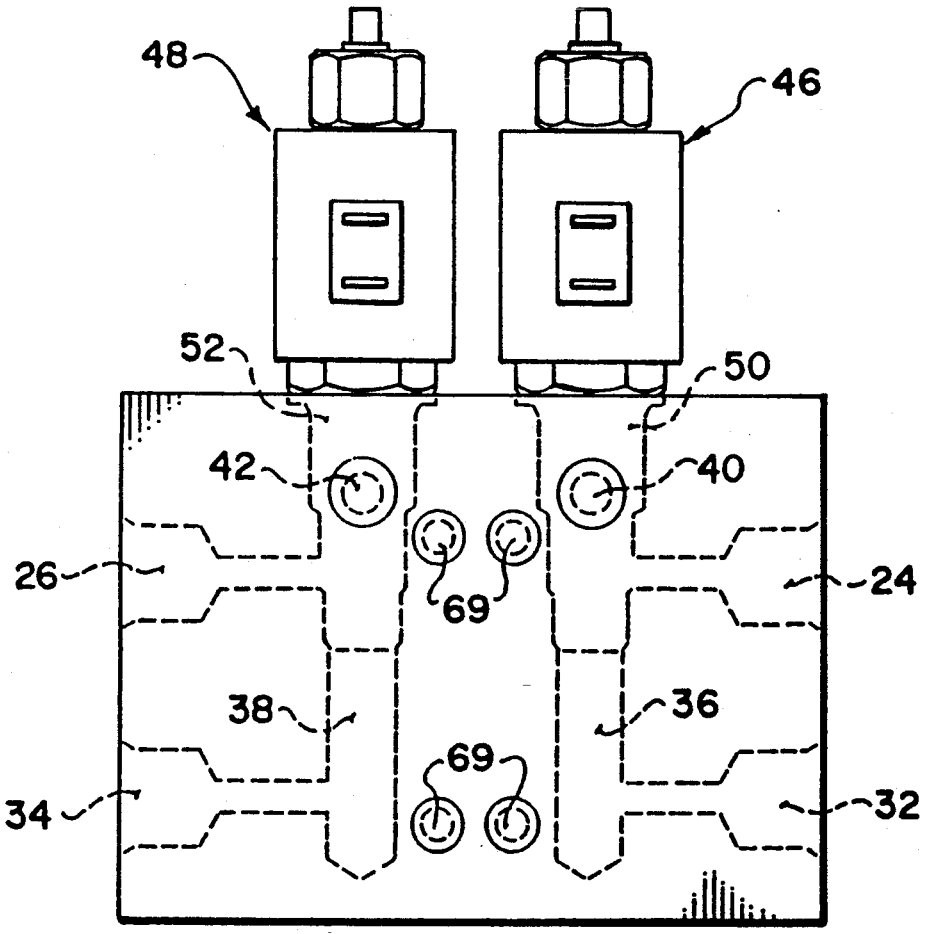
FIG. 5 is side view of the conversion manifold of FIG. 2.

As shown best in FIG. 5, manifold 10 has a pair of internal conduits 36 and 38. Conduit 36 connects starboard inlet port 24 and starboard outlet port 32; conduit 38 similarly connects port inlet port 26 and port outlet port 34. As discussed further below, conduits 36,38 enable the flow of hydraulic fluid from helm pump 12 through manifold 10, directly to steering cylinder 14 in the event of a power failure.

Figure 3:
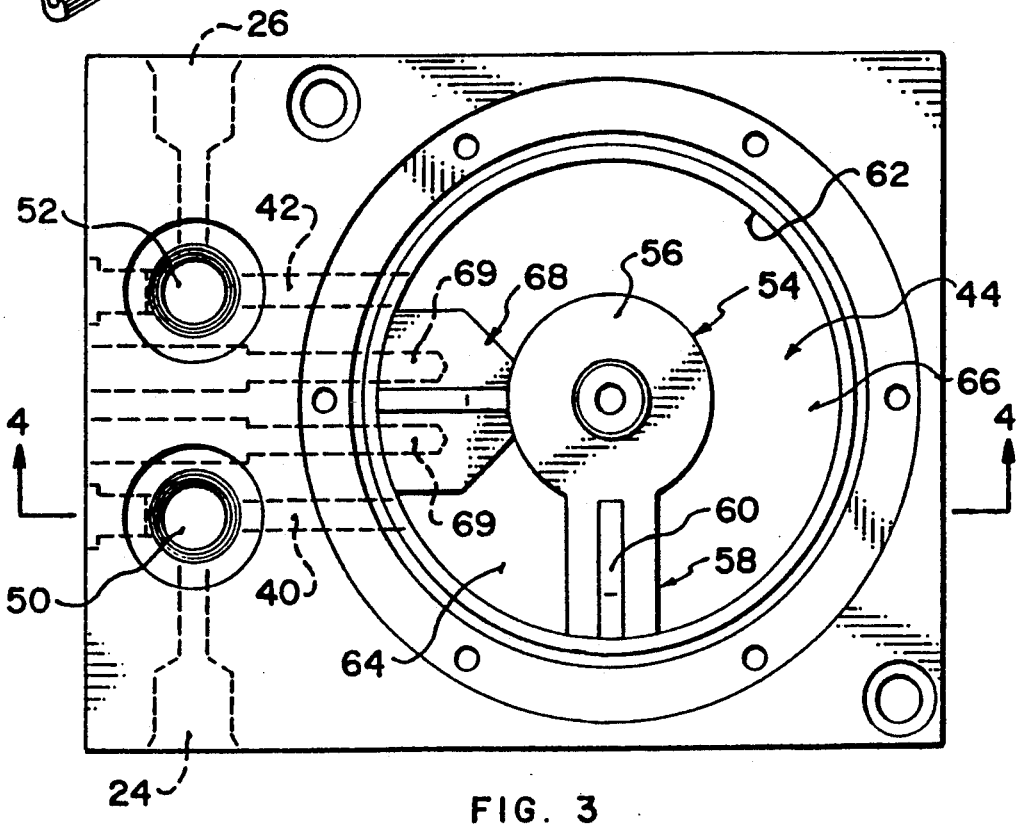
FIG. 3 is a top view of the conversion manifold of FIG. 2.
Figure 4:
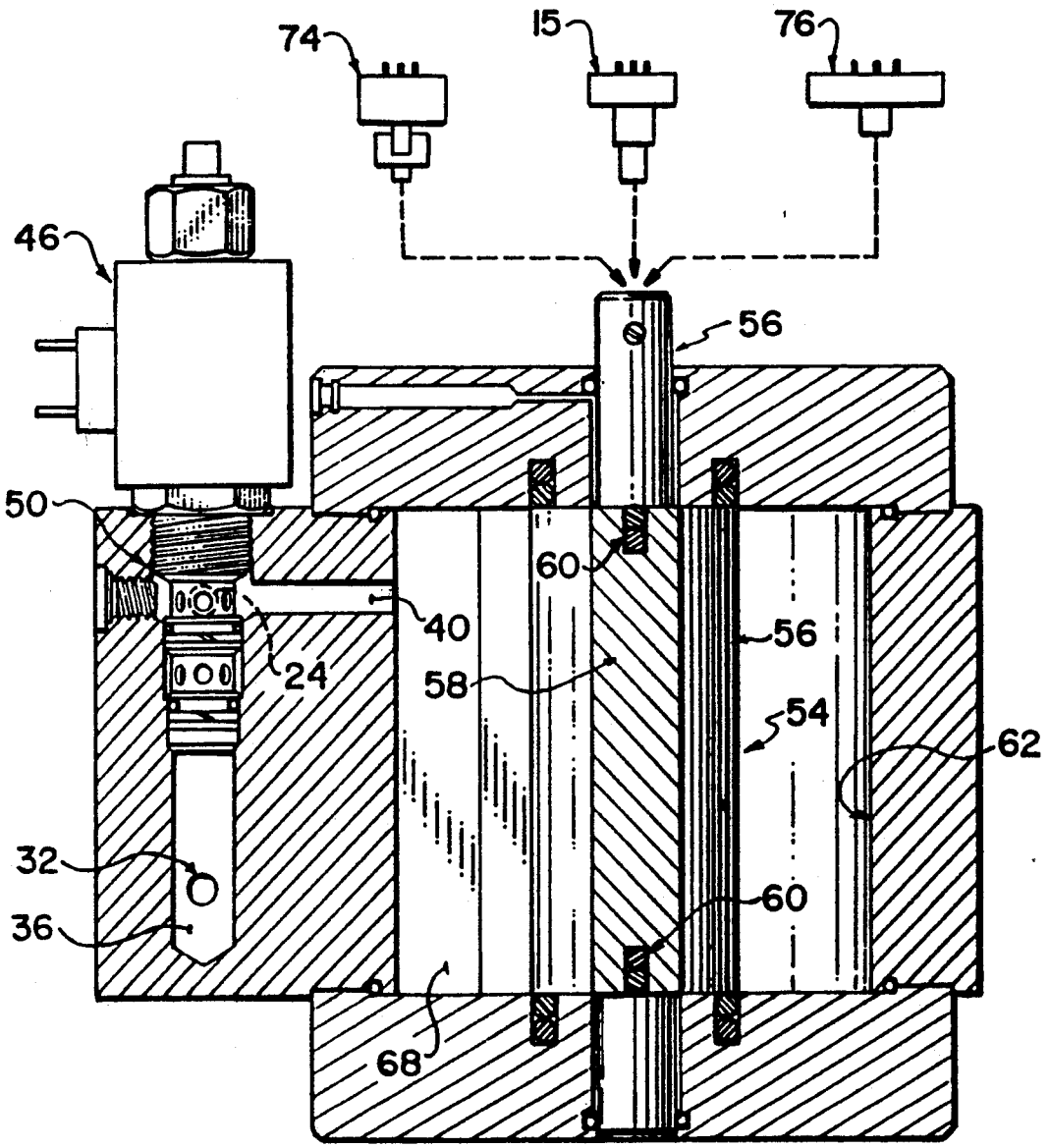
FIG. 4 is a front sectional view taken along lines section 4—4 of FIG. 3.

Manifold 10 also includes a further pair of conduits 40,42 which enable the flow of hydraulic fluid from inlet ports 24,26 into internal hydraulic fluid chamber 44. Conduit 40 is in controlled communication with conduit 36 and conduit 42 is similarly in controlled communication with conduit 38. The flow of hydraulic fluid into conduits 40,42 is controlled by a pair of diverter valves. The diverter valves are preferably solenoid cartridge valves 46,48 which are screwed into access holes 50,52 located in the top face of manifold 10 (FIGS. 3 and 5). Solenoid cartridge valves 46,48 are connectable to a 10 conventional power source. When the solenoids of valves 46,48 are energized, a valve plunger closes conduits 36,38 and diverts hydraulic fluid received from helm pump 12 into conduit 40 or 42, as the case may be, and hence into internal chamber 44.

As shown best in FIG. 3, internal chamber 44 is fitted with a rotary actuator generally designated 54. The actuator comprises a rotor shaft 56 and a rotor vane 58 extending radially from shaft 56. The outermost end of rotor shaft 56 is coupled to potentiometer 15. Actuator 54 is preferably constructed from brass, although any other suitable oil-resistant metal or plastic material may be used. The distal, free end of vane 58 is preferably fitted with a U-shaped seal 60 which sealingly engages the sidewall 62 of chamber 44 to divide chamber 44 into two separated, substantially fluid-tight compartments 64,66. Actuator 54 rotates about a rotor stator 68 which is securely mounted at one circumferential position on sidewall 62 of chamber 44 such as with dowel pins 69. Conduit 40 communicates with compartment 64 on one side of stator 68 and conduit 42 communicates with compartment 66 on the other side of stator 68. Rotor stator 68 separates compartments 64,66 and limits complete rotation of vane 58 as best seen in FIG. 2.

As discussed aforesaid, when power is applied to solenoid valves 46,48 these valves divert hydraulic fluid from helm pump 12 into conduits 40,42 and hence into compartment 64 or 66 of internal chamber 44. For example, if steering wheel 11 of the vessel is turned clockwise, hydraulic fluid is pumped from helm pump 12, through starboard supply line 20 into manifold inlet 24. From here the hydraulic fluid is diverted by valve 46 into conduit 40 which empties into compartment 64. The increased fluid pressure in compartment 64 causes rotation of actuator 54 and hence potentiometer 15. The hydraulic fluid in compartment 66 which is displaced by rotation of actuator 54 is forced into conduit 42. The displaced fluid passes out of inlet 34 into port fluid supply line 22 to return to the helm pump hydraulic fluid reservoir.

If steering wheel 11 of the vessel is rotated counterclockwise, hydraulic fluid circulates in the opposite direction. That is, hydraulic fluid passes from port supply line 22 into manifold inlet 26 where it is diverted by solenoid valve 48 into conduit 42 which empties into compartment 66. The increased fluid pressure in compartment 66 causes rotation of actuator 54 and hence potentiometer 15. The hydraulic fluid which is displaced by rotation of actuator 54 is forced into conduit 40. The displaced fluid passes out of starboard port 24 into fluid supply line 20 to return to the helm pump hydraulic fluid reservoir.

The potentiometer is calibrated in a conventional manner to produce an electrical signal representative of the change of position of rotary actuator 54. Thus the present invention converts a manual hydraulic steering signal into a proportional electrical signal. Referring to FIG. 1, the electrical signal generated by the potentiometer 15 is transmitted to amplifier 16 which is preferably installed proximate to manifold 10 and pumpset 18 in order to limit cable lengths. Amplifier 16 sends a corresponding output current to one or more directional control valves on pumpset 18 which in turn regulate the flow of fluid from pumpset 18 through fluid supply lines 70, 72 to steering cylinder 14 to result in the desired change in position of rudder 17. As shown in FIG. 1, fluid supply lines 70, 72 may be linked to fluid supply lines 28 and 30 respectively.

Typically potentiometer 15 and amplifier 16 are calibrated so that 3 1/2 or 4 rotations of steering wheel 11 are required to go from hardover to hardover when power is applied. The volume of internal chamber 44 may also be varied to alter the number of wheel rotations required to go from hardover to hardover positions.

When solenoid valves 46,48 are deenergized, such as during a power failure, the valve plungers automatically block access to conduits 40,42 so that hydraulic fluid from helm pump 12 is shunted directly through conduits 36,38 to outlet ports 32,34 and hence to steering cylinder 14, as described above. Solenoid valves 42,44 are Wired together so that if one valve fails, both with fail. In the unlikely event that a valve is stuck in an energized position after a power failure (for example, if the hydraulic fluid is contaminated by dirt which prevents proper operation of the valve) the pilot may manually switch the valve to the deenergized position by pushing the solenoid cartridge inwardly at access holes 50 or 52, as the case may be. Thus the emergency manual steering system is fail safe. The pilot of the vessel will feel more resistance to rotation of the steering wheel as the vessel automatically switches from power to manual steering. The vessel may be steered from the helm until the power failure is remedied; thus it is not necessary for the pilot to relay instructions to remote operators in the steering flat in order to effectively control the vessel.

Manifold 10 is typically constructed by first boring internal chamber 44 and then boring parallel conduits 40,42 from one side of manifold 10 into chamber 44. Bore holes are also drilled parallel to conduits 40,42 to enable insertion of dowel pins 69 to mount rotor stator 68 on the sidewall 62 of internal chamber 44. After dowel pins 69 have been inserted the aforesaid access holes are plugged (FIG. 5).

Solenoid access holes 50,52 and conduits 36,38 are then bored perpendicular to, and in communication with, conduits 40,42. Inlet ports 24,26 and outlet ports 32,34 are also bored so that they are in communication with conduits 36,38. After manifold 10 is examined to ensure proper communication between the conduits and the inlet and outlet ports, the ends of conduits 40,42 remote from internal chamber 44 are plugged. Rotor shaft 56 and vane 58 are then fitted within chamber 44 for rotation about stator 68. After actuator 54 is fitted into position the top cover plate is screwed on to cover chamber 44 and the solenoid cartridge valves 46,48 are placed in access holes 50,52. Manifold 10 is thus ready for attachment to the fluid supply lines leading to helm pump 12 and steering cylinder 14.

In operation, conversion manifold 10 is preferably installed in the wheelhouse of the vessel in question proximate to helm pump 12 to enable easy access by the pilot, although it may be installed anywhere between the helm pump and the steering cylinder. Further, manifold 10 may be installed in any orientation. Mounting holes are provided to facilitate mounting manifold 10 on any suitably rigid support structure.

To retrofit manifold 10 into an existing vessel, the fluid supply lines 20 and 22 are first connected to corresponding manifold inlet ports 24,26. Fluid supply lines 28, 30 are similarly connected to the manifold outlet ports 32,34. Helm pump 12 and steering cylinder 14 are then carefully filled with hydraulic fluid. The power supply is connected to energize manifold solenoid valves 46, 48 to enable flow of hydraulic fluid into internal chamber 44. To complete the initial set-up the operator should then rotate steering wheel 11 slowly in one direction (for example, clockwise) until rotary actuator 54 reaches the hardover position bearing against rotor stator 68. The return line fitting (i.e. fluid supply line 22) should then be opened slightly to allow any air to vent to atmosphere. Steering wheel 11 should then be rotated in the opposite direction (i.e counterclockwise) and fluid supply line 20 should be opened slightly to allow venting of air. The above procedure should be repeated until manifold 10 is completely purged of air.

Manifold 10 is designed to interface with conventional commercial autopilots having an amplifier 16 capable of accepting foreign commands. Thus, if an autopilot is already installed in the vessel in question, it is not ordinarily necessary to retrofit amplifier 16 and pumpset 18 in addition to conversion manifold 10 and potentiometer 15.

In an alternative embodiment of the invention a linear actuator may be substituted for rotary actuator 54 described above. The primary advantage of rotary actuator 54 is its compact size. However, one advantage of a linear actuator is that circular rather than U-shaped seals may be used to separate fluid compartments 64 and 66.

Similarly, detection devices other than potentiometer 15 may used to convert rotary movement of actuator 54 into an electrical signal. For example, a hall effect switch (magnetic field sensor) or an optical encoder can be used to like effect.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A conversion manifold connectable between a hydraulic fluid supply and a hydraulic cylinder comprising:

(a) at least one inlet port for receiving hydraulic fluid from said hydraulic fluid supply;

(b) at least one outlet port for enabling delivery of hydraulic fluid from said manifold to said cylinder;

(c) a first conduit connecting said inlet port and said outlet port;

(d) an internal chamber within said manifold in communication with said first conduit;

(e) diverter means for selectively diverting hydraulic fluid from said first conduit into said internal chamber;

(f) an actuator mounted within said internal chamber responsive to variation in the flow of fluid into said internal chamber; and (g) signal generating means cooperating with said actuator for generating an electrical signal proportional to the change in position of said actuator.

2. A conversion manifold as defined in claim 1, further comprising a second conduit in communication with said first conduit in said internal chamber.

3. A conversion manifold as defined in claim 2, wherein said diverter means comprises a valve positionable at the juncture of said first conduit and said second conduit, wherein said valve is adjustable between a first position enabling flow of hydraulic fluid from said first conduit into said second conduit and a second position preventing flow of hydraulic fluid from said first conduit into said second conduit.

4. A conversion manifold as defined in claim 3, wherein said diverter means is a solenoid cartridge valve connectable to a power source, wherein said valve is deployed in said first position when said solenoid is energized and is deployed in said second position when said solenoid is deenergized.

5. A conversion manifold as defined in claim 1, wherein said chamber is cylindrical and wherein said actuator is a rotor having a vane rotatable about a shaft extending through the centre of said chamber, said vane dividing said chamber into two substantially fluid-tight portions.

6. A conversion manifold as defined in claim 5, wherein said signal generating means is a potentiometer coupled to one end of said rotor shaft.

7. A conversion manifold connectable between a hydraulic fluid supply and a hydraulic cylinder, wherein said manifold is a unitary block comprising:

(a) first and second inlet ports for receiving hydraulic fluid from said fluid supply;

(b) first second outlet ports enabling delivery of hydraulic fluid from said manifold to said cylinder;

(c) a first conduit connecting said first inlet port and said first outlet port;

(d) a second conduit connecting said second inlet port and said second outlet port;

(e) an internal chamber within said manifold housing a rotary actuator responsive to variation of flow of hydraulic fluid into said chamber, said actuator having a vane rotatable about a shaft extending through said chamber, said vane dividing said chamber into two substantially fluid-tight portions;

(f) a third conduit connecting said first conduit to one of said chamber portions;

(g) a fourth conduit connecting said second conduit to the other chamber portion;

(h) a first diverter valve positionable at the juncture between said first conduit and said third conduit for selectively diverting hydraulic fluid from said first conduit into one of said chamber portions;

(i) a second diverter valve positionable at the juncture of said second conduit and said fourth conduit for selectively diverting hydraulic fluid from said second conduit into the other of said chamber portions; and (j) signal generating means cooperating with said actuator for generating an electrical signal proportional to the change in position of said actuator.

8. A conversion manifold as defined in claim 7, wherein said first and second diverter valves are adjustable between a first position enabling flow of hydraulic fluid from said first and second conduits into said internal chamber and a second postion preventing flow of hydraulic fluid from said first and second conduits into said internal chamber.

9. A conversion manifold as defined in claim 7, wherein said first inlet port and said second inlet port are located on opposite sides of said manifold and wherein said first outlet port and said second outlet port are located on opposite sides of said manifold.

10. A conversion manifold as defined in claim 8, wherein said first and second diverter valves are solenoid cartridge valves connectable to a power source, wherein said valves are deployed in said first position when said solenoids are energized and are deployed in said second position when said solenoids are deenergized.

11. A conversion manifold as defined in claim 7, wherein said signal generating means is a potentiometer coupled to one end of said rotor shaft.

12. The conversion manifold as defined in claim 1, wherein said actuator is a linear hydraulic cylinder.

13. The conversion manifold as defined in claim 1, wherein said signal generating means is a magnetic field sensor.

14. The conversion manifold as defined in claim 1, wherein said signal generating means is an optical encoder.

15. In a hydraulic steering system having a helm pump for supplying hydraulic fluid to a hydraulic steering cylinder, and a potentiometer, amplifier and pumpset for regulating flow of hydraulic fluid to said steering cylinder, the improvement comprising providing a conversion manifold connectable between said helm pump and said steering cylinder for generating an electrical signal responsive to the variation in flow of hydraulic fluid from said helm pump, said conversion manifold comprising:

(a) at least one inlet port for receiving hydraulic fluid from said helm pump;

(b) at least one outlet port for enabling delivery of hydraulic fluid from said manifold to said cylinder;

(c) a first conduit connecting said inlet port and said outlet port;

(d) an internal chamber within said manifold in communication with said first conduit;

(e) diverter means for selectively diverting hydraulic fluid from said first conduit into said internal chamber;

(f) an actuator mounted within said internal chamber responsive to variation in the flow of fluid into said internal chamber, wherein said potentiometer cooperates with said actuator to generate an electrical signal proportional to the change in position of said actuator; and (g) means for transmitting said generated electrical signal to said pumpset via said amplifier to cause said pumpset to deliver hydraulic fluid to said steering signal in proportion to said generated signal.

16. A steering system as defined in claim 15, wherein said conversion manifold further comprises a second conduit in communication with said first conduit and said internal chamber.

17. A steering system as defined in claim 16, wherein said diverter means comprises a valve positionable at the juncture of said first conduit and said second conduit, wherein said valve is adjustable between a first position enabling flow of hydraulic fluid from said first conduit into said second conduit and a second position preventing flow of hydraulic fluid from said first conduit into said second conduit.

18. A steering system as defined in claim 17, wherein said diverter means is a solenoid cartridge valve connectable to a power source, wherein said valve is deployed in said first position when said solenoid is energized and is deployed in said second position when said solenoid is deenergized.

19. A steering system as defined in claim 18, wherein said chamber is cylindrical and wherein said actuator is a rotor having a vane rotatable about a shaft extending through the centre of said chamber, said vane dividing said chamber into two substantially fluid tight portions.

20. A method for converting a manual steering system comprising a hydraulic fluid supply and a hydraulic steering cylinder to a power steering system, comprising the steps of:

(a) connecting a conversion manifold between said hydraulic fluid supply and said hydraulic cylinder, said conversion manifold having a chamber housing an actuator responsive to the flow of hydraulic fluid into said chamber;

(b) delivering hydraulic fluid from said hydraulic fluid supply to said manifold;

(c) selectively diverting hydraulic fluid received from said hydraulic fluid supply into said chamber to cause displacement of said actuator;

(d) generating an electrical signal proportional to the change in position of said actuator;

(e) transmitting said generated signal to a pumpset having a hydraulic fluid supply; and (f) delivering hydraulic fluid from said pumpset to said steering cylinder in proportion to said generated signal.

* * * * *